United States Patent [19]

Dlubek

[11] 3,997,334

[45] Dec. 14, 1976

[54] INTRODUCTION OF A LIQUID INTO A RECEPTACLE SUCH AS A CONVERTER

[75] Inventor: Stanislas Dlubek, Montignies-le-Tilleul, Belgium

[73] Assignee: Centre de Recherches Metallurgiques-Centrum voor Research in de Metallurgie, Brussels, Belgium

[22] Filed: May 15, 1975

[21] Appl. No.: 577,783

Related U.S. Application Data

[63] Continuation of Ser. No. 354,435.

[30] Foreign Application Priority Data

Apr. 28, 1972 Belgium ..... 782888

[52] U.S. Cl. ..... 75/60; 75/61; 137/605; 417/307

[51] Int. Cl.[2] ..... C21C 5/30; F04B 49/08

[58] Field of Search ..... 75/60, 61; 137/604, 137/605; 417/307

[56] References Cited

UNITED STATES PATENTS 3,817,744 6/1974 Leroy ..... 75/60

FOREIGN PATENTS OR APPLICATIONS 1,450,718 8/1966 France ..... 75/60

*Primary Examiner*—Peter D. Rosenberg
*Attorney, Agent, or Firm*—Holman & Stern

[57] ABSTRACT

A liquid fuel or other liquid is supplied to a supply line which communicates with an injection conduit opening out into a receptacle such as a steelmaking converter. The supply line includes a non-return valve which allows the liquid to pass only when its pressure exceeds a given critical pressure. A gas is introduced into the supply line downstream of the non-return valve at a pressure which is hgher than the critical pressure and which is sufficient to prevent any material in the receptacle from penetrating into the injection conduit.

10 Claims, 1 Drawing Figure

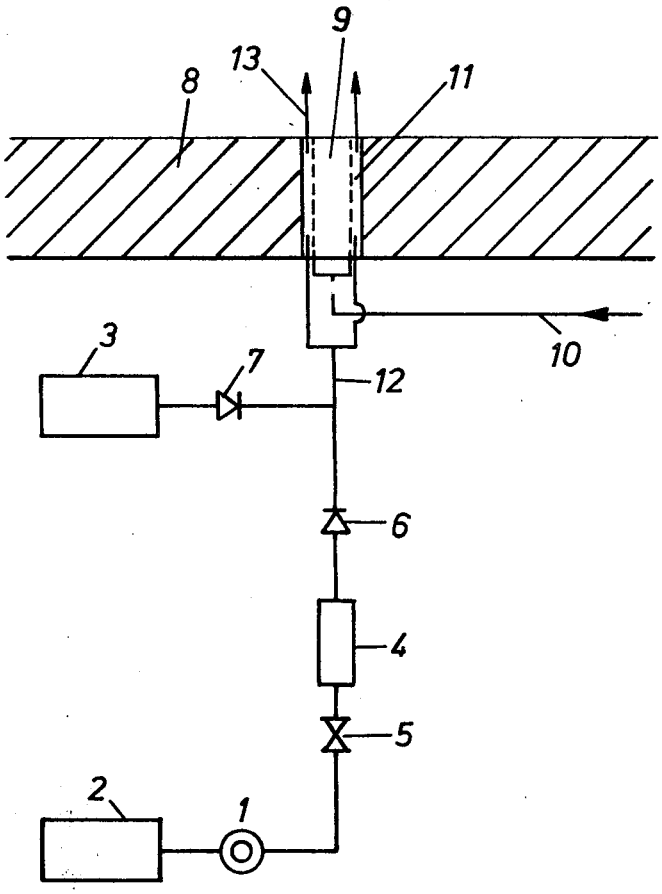
9
13
8
11
3
7
12
10
6
4
5
2
1

INTRODUCTION OF A LIQUID INTO A RECEPTACLE SUCH AS A CONVERTER

This is a continuation of application Ser. No. 354,435 filed Apr. 25, 1973 now abandoned.

BACKGROUND OF THE INVENTION

The present invention relates to a method for the introduction of a liquid, such as a liquid fuel, into a receptacle such as a steelmaking converter, especially into a converter in which refining is achieved by means of industrially pure oxygen blown into the converter through its bottom or its lateral wall.

The injection of industrially pure oxygen through the bottom or lateral wall of a converter generally involves the use of at least one tuyere comprising two coaxial conduits, with the central conduit being used to introduce oxygen and the peripheral conduit to allow the passage of a shielding fluid. In the event of the tuyere or tuyeres being housed in the lateral wall, they are located below the normal upper level of the metal when the converter is in the vertical position.

When a liquid shielding fluid is used, it is most usually a hydrocarbon, the vaporization and endothermic decomposition of which at the outlet of the peripheral conduit, inside of the converter, are particularly advantageous from the point of view of protecting the bottom or lateral wall from attack by the oxygen. More generally, this shielding liquid is injected into the converter in such a way that its pressure at the tuyers aperture on the inside of the converter is at least 1 $kg/cm^2$.

With this type of injection, certain particularly unpleasant disadvantages may manifest themselves during sudden and unforeseen variations in the pressure of the liquid supplied by the peripheral conduit.

Such a variation, involving a rapid drop in pressure, may be caused by the following circumstances. At the outlet apertures of the peripheral conduits inside the converter it is possible, in certain circumstances, for metallic deposits to form and partially block the apertures. These then allow the passage of only part of the liquid which is to be introduced and, in order to maintain the effective flow of the liquid unchanged or to keep it at a minimum value, it is necessary to increase its supply pressure. It should be remembered that in the present case, the rate of flow of the liquid shielding fluid can hardly be modified at all generally speaking, because if it is too low, the protection of the converter refractories is incomplete and if it is too high, part of the fluid is not decomposed and ends up leaving the converter unused or unburnt.

It may be that the metallic deposits to which reference is made above suddenly become detached from the place where they were fixed and this clearly and rapidly facilitates the passage of the shielding liquid through the peripheral conduits of the tuyeres; since, at this moment, the injection pressure of the liquid is greater than that needed to ensure the desired rate of flow in the absence of any back pressure or parasitic pressure loss (for example resulting from the presence of such deposits), the rate of flow of the shielding fluid suddenly increases significantly, and the drawbacks referred to above manifest themselves. In extreme cases, the surplus fluid is discharged from the converter, polluting either the neighboring areas or the external wall of the converter. It has even been shown that this surplus liquid may progressively impregnate the refractories of the converter lining until it passes through them completely and oozes out of them. In such cases, there is an obvious need to reduce as quickly as possible the pressure at which the liquid is delivered by its supply pump, but this can, in most cases, only be achieved after a certain delay and thus it is not possible to avoid the disadvantages which have been referred to.

Similar difficulties may manifest themselves when it is desired to increase the pressure at which the liquid is supplied, as an increase in this pressure leads the pressure drop and back pressure being unaltered) to a corresponding increase in the rate of flow, this being undesirable.

What is desired is a method allowing a simple control of the introduction of liquid, such as a fuel, into a receptacle, such as a converter (beneath the level of the molten metal), through at least one injection conduit; this conduit may for example, be the peripheral conduit of a blowing tuyere having two coaxial conduits, housed in the bottom or lateral wall of a converter, with the central conduit serving to blow in an oxidizing gas.

SUMMARY OF THE INVENTION

The present invention provides a method of introducing a liquid into a receptacle, comprising supplying the liquid to a supply line which communicates with at least one injection conduit opening out into the receptacle, the supply line including a non-return valve, which allows the liquid to pass only when its pressure exceeds a given critical pressure, and introducing a gas into the liquid in the supply line downstream of the non-return valve at a pressure which is higher than the critical pressure and which is sufficient to prevent any material in the receptacle from penetrating into the at least one injection conduit, whereby a mixture of gas and liquid is introduced into the receptacle.

BRIEF DESCRIPTION OF THE DRAWING

The invention will be described further, by way of example, only with reference to the accompanying drawings, in which the sole FIGURE. diagramatically shows an arrangement for introducing a shielding liquid into a bottom-blown converter.

DETAILED DESCRIPTION OF THE INVENTION

A pump 1 draws liquid fuel from a supply reservoir 2 and feeds it to the converter along a line 12. A reservoir 3 of neutral or inert gas under a given pressure is connected to the line 12 through a non-return valve 7. A Rotameter (Trade Mark) flow rate meter 4 equipped with a gate valve 5, is inserted in the line 12. A non-return valve 6 set at a predetermined minimum delivery pressure, is arranged downstream of the meter 4. The non-return valve 7 at the output of the gas reservoir 3 is adjusted to a delivery pressure greater than the minimum delivery pressure of the valve 6. A bottom 8 of a converter is provided with a tuyere consisting of a central duct 9 for blowing in refining oxygen supplied by a conduit 10, and a peripheral duct 11 supplied with liquid fuel through the line 12, with the fuel entering the converter according to the arrows 13.

The arrangement functions as follows: In the absence of any back-pressure in the supply line 12, the pressure of the liquid fuel at the output of the pump 1 is controlled in such a way that the meter 4 shows the desired rate of flow. This output pressure is thus the critical pressure. The non-return valve 6 is adjusted so as to allow the passage of the fuel as soon as the delivery pressure exceeds this critical value (in this case, for example, 2 kg/cm$^2$).

When liquid fuel is not injected, the gas reservoir 3 delivers gas into the line 12 via its non-return valve 7 at a suitable pressure (for example 4 kg/cm$^2$). Thus, the peripheral duct 11 of the tuyere is protected against the entry of any metal from the converter; moreover, the valve 6 is closed because the gas pressure is higher than its minimum delivery pressure; the pump therefore delivers no liquid fuel.

The pump is set in operation, its output pressure increases progressively, and the fuel starts to pass through the valve 6 when its pressure reaches that of the gas delivered by the valve 7. The output pressure of the fuel is further increased until the meter 4 shows the desired rate of flow; thus, at this moment, a gas-fuel mixture is injected into the converter at a pressure which is virtually equal to that delivered by the valve 7.

If, for any reason, resistance to the injection of the fuel-gas mixture into the converter drops suddenly, the rate of flow of gas from the reservoir 3 through the valve 7 will automatically and instantaneously increase so as to re-establish the original pressure of 4 kg/cm$^2$, whereas the pump 1, which is slow in reacting, would still be subjected to the same back-pressure on valve 6 and would not deliver more fuel.

If it is desired to reduce the pressure at which the fuel is to be injected, firstly the work pressure is reduced by the desired value, with this in turn reducing the rate of flow of the injected fuel, and then there is a corresponding reduction in the delivery-pressure setting of the valve 7, so as to re-establish the rate of flow of the fuel at its original value.

Moreover, if it is desired to increase the pressure at which the fuel is to be injected (without increasing its rate of flow) all that is required is to modify in the desired sense the adjustment of the valve 7, with this leading to a reduction in the rate of flow of injected fuel; the rate of delivery of the supply pump 1 is then increased in order to re-establish the rate of flow of fuel at its desired value.

An important feature of the method illustrated in the drawing is that the neutral or inert gas is introduced into the supply line, downstream of the pump and the non-return valve, at a pressure which is, on the one hand, greater than the critical pressure setting of the non-return valve and on the other hand, sufficient to prevent material in the receptacle from penetrating into the injection conduit, this pressure preferably being substantially equal to the injection pressure at which it is desired to inject the gas-liquid mixture into the receptacle. It will be understood that the delivery pressure of the pump is equal to the work pressure, this being the sum of the critical pressure and the injection pressure.

The method described above thus makes it possible to inject, at a given pressure, a set rate of flow of a liquid into a receptacle such as a converter provided with its charge. Whatever the value of the injection pressure, so long as this is higher than the critical pressure of the non-return valve, it is possible to control the rate of flow of the liquid fluid so that it stays at the value set for the critical pressure.

Once the injection process has been set in operation as described above, it offers a particularly significant advantage from the point of view of safety. In the event of the resistance to the input of liquid into the converter dropping suddenly and unexpectedly, the pressure of the gas introduced into the supply line remains unchanged, and as a result the delivery pressure is unchanged as well; the result of this is that the rate of flow of liquid is not increased; it is only the rate of flow of gas which has been introduced which has automatically increased in such a way that the pressure losses corresponding to the new rate of flow compensate for the drop in resistance which has occurred.

It is possible to modify in a desired sense the pressure at which the liquid is injected into the receptacle, without however modifying its rate of flow.

In order to increase this injection pressure by a certain value, the pressure at which the gas is introduced into the supply line is increased by this value, the delivery pressure of the pump is then increased by the same value, with the increase in the delivery pressure being unable to precede the increase in the pressure at which the gas is introduced; if reduction of the injection pressure of the liquid by a certain value is required, the delivery pressure of the liquid is reduced by this value, with the pressure at which the gas is injected subsequently being reduced by the same value.

It is obvious that during the short period of time occupied by the two operations just described, the rate of flow of the liquid undergoes a slight reduction followed by an increase which restores it to its initial value; it should therefore be understood that there must be some modification of the rate of flow during this short period of operation, although the rate remains the same before and after the operation.

It is to be noted that the process also facilitates, where the need is felt, modification in the desired sense of the rate of flow of the liquid which is injected, whether the injection pressure is to be maintained or not, and all that is required is modification in the desired sence by the desired value of the delivery pressure of the liquid, followed possibly by that of the injected gas.

I claim:

1. A method of introducing a liquid into a receptacle comprising supplying the liquid to a supply line which communicates with at least one injection conduit opening out into the receptacle, providing the supply line with a non-return valve allowing the liquid to pass only when the liquid pressure exceeds a given critical pressure, and introducing a gas into the liquid in the supply line downstream of the non-return valve at a pressure sufficient to prevent any material in the receptacle from penetrating into the at least one injection conduit, whereby a mixture of gas and liquid is introduced into the receptacle.

2. The method as claimed in claim 1, wherein said critical pressure is substantially equal to the pressure drop between the non-return valve and the at least one injection conduit when the receptacle is empty.

3. The method as claimed in claim 1, wherein the gas pressure is substantially equal to the pressure at which the gas-liquid mixture enters the receptacle.

4. The method as claimed in claim 1, including increasing the pressure at which the gas-liquid mixture enters the receptacle, with the liquid flow rate being the same before and after the pressure increase, by increasing the gas pressure and then increasing the pressure at which the liquid is supplied until the liquid flow rate returns to the value which it has before the increase.

5. The method as claimed in claim 1, including decreasing the pressure at which the gas-liquid mixture enters the receptacle, with the liquid flow rate being the same before and after the pressure decrease, by decreasing the pressure at which the liquid is supplied and then decreasing the gas pressure.

6. The method as claimed in claim 1, wherein the receptacle is a steelmaking converter having in the bottom of the lateral wall at least one tuyere with two conduits one inside the other, the liquid being a shielding liquid introduced into the converter through the outer conduit of the tuyere, and introducing an oxidizing gas or other fluid into the converter through the inner conduit.

7. The method as claimed in claim 1, wherein the liquid is a fuel.

8. Apparatus for introducing liquid into a receptacle, comprising at least one injection conduit opening out into the receptacle, a liquid supply pump, a supply line communicating between the pump and the at least one injection conduit, a non-return valve in the supply line adapted to allow the liquid to pass only when its pressure exceeds a given critical value, and a gas supply arranged to introduce a gas into the supply line downstream of the non-return valve.

9. Apparatus as claimed in claim 8, further comprising a liquid flow rate meter in the supply line between the pump and the non-return valve.

10. Apparatus as claimed in claim 8, wherein the receptacle is a steelmaking converter and the injection conduit is the outer conduit of a tuyere comprising two conduits one inside the other.

* * * * *